US005143237A

United States Patent [19]

Lindsey et al.

[11] Patent Number: 5,143,237

[45] Date of Patent: Sep. 1, 1992

[54] RATCHET CAP FOR MOUNTING A DISPENSING DEVICE ONTO A CONTAINER

[75] Inventors: Lewis K. Lindsey; Douglas S. Martin, both of Forest City, N.C.

[73] Assignee: AFA Products, Inc., Forest City, N.C.

[21] Appl. No.: 762,761

[22] Filed: Sep. 20, 1991

[51] Int. Cl.[5] ..... B65D 41/04

[52] U.S. Cl. ..... 215/330; 215/216

[58] Field of Search ..... 215/330, 216, 221

[56] References Cited

U.S. PATENT DOCUMENTS

| | | | |
|---|---|---|---|
| 2,124,638 | 7/1938 | Sheldon et al. | 215/252 |
| 3,407,976 | 10/1968 | Homma | 215/250 |
| 3,924,769 | 12/1975 | Fillmore | 215/216 |
| 3,944,101 | 3/1976 | Landen et al. | 215/216 |
| 4,345,691 | 8/1982 | Burke | 215/216 |
| 4,413,743 | 11/1983 | Summers | 215/216 |
| 4,736,859 | 4/1988 | Mayes et al. | 215/330 |
| 4,913,299 | 4/1990 | Petro | 215/330 |
| 4,991,733 | 2/1991 | Marino | 215/330 |

*Primary Examiner*—Gary E. Elkins
*Assistant Examiner*—Nova Stucker
*Attorney, Agent, or Firm*—Thomas R. Vigil

[57] ABSTRACT

A connecting assembly for mounting a fluid dispensing assembly onto a container comprises a cap for receiving and connecting the dispensing device onto the container and a cylindrical neck finish on top of the container for receiving the cap. The cap as well as the cylindrical neck finish have threads for mutual engagement.

Furthermore, the cap has an orifice within its top wall for receiving the fluid dispensing device.

Ratchet teeth inside the cap and corresponding ratchet teeth outside the cylindrical neck finish engage mutually to prevent the cap from being unlocked accidently. The ratchet teeth inside the cap have a rearwardly extending short back face and a forwardly extending long front face whereby the short back face and the long front face form an acute but almost rectangular angle. The short back face of one ratchet tooth extends of the bottom of a long front face of an adjacent ratchet tooth. The ratchet teeth inside the cap are uniformly distributed.

The short back faces of any ratchet teeth have a slight slant, preferably 10 degree, off a radial line passing through the center of the cap and the slight slant is a trailing slant.

15 Claims, 4 Drawing Sheets

RATCHET CAP FOR MOUNTING A DISPENSING DEVICE ONTO A CONTAINER

BACKGROUND OF THE INVENTION

1. Field of the Invention

The present invention relates to a ratchet cap for connecting a fluid dispensing device to a container. The dispensing device, i.e. a trigger sprayer, includes a pumping mechanism for pumping a desired amount of liquid out of the container and a nozzle assembly for proper dispensing of the fluid. The dispensing device is mounted onto the container and the cap connects the dispensing device to the container.

More specifically, the present invention relates to a ratchet cap having a number of specially configured ratchet teeth for providing an air tight connection of the dispensing device onto the container and a child resistant locking thereof, but yet permitting forced removal of the cap from the container.

2. Description of the related art including information disclosed under 37 CFR §1.97–1.99.

It is well known in the art of dispensing devices to mount a dispensing device onto a container by using a cap.

Heretofore, it has also been proposed to use a cap having ratchet teeth for connecting a dispensing device onto a container, as disclosed in the following patent:

| U.S. Pat. No. | Patentee |
|---|---|
| 4,345,691 | Burke |

In the Burke U.S. Pat. No. 4,345,691 a child resistance closure for a pump or dispensing device connected onto a bottle or container is disclosed. The closure is a cap having a hole in the top for receipt of the pump or dispensing device and threads on the inside walls for engaging threads located on the container neck. The cap has a series of ratchet teeth on the inside wall for engaging a series of ratchet teeth on the bottle neck to prevent the cap from being removed from the container.

The interior of the cap contains threads and at the very bottom thereof a series of beveled ratchet teeth having a rear edge, a front edge and a beveled edge. The rear edge is substantially radially disposed relative to a tangent to a circular ridge of the cap.

The connecting assembly of the present invention is significantly different from the prior Burke connecting assembly by providing a cap having teeth which have a nominally disposed back face that slants rearwardly, such as at an angle of 10 degree relative to a radius that is normal to a tangent of the circular periphery of the cap.

SUMMARY OF THE INVENTION

The present invention relates to a connecting assembly including a ratchet cap for connecting to a container and more particularly for connecting a fluid dispensing device, i.e. a trigger sprayer, to the container.

The ratchet cap connects the dispensing device to a cylindrical neck finish on top of the container. The cap as well as the cylindrical neck finish have threads for mutual engagement.

Furthermore, the cap has an orifice within its top wall for receiving the fluid dispensing device.

Ratchet teeth inside the cap and corresponding ratchet teeth outside the cylindrical neck finish engage mutually to prevent the cap from being unlocked accidentally. The ratchet teeth inside the cap have a rearwardly extending short back face and a forwardly extending long front face. The short back face and the long front face form an acute but almost rectangular angle. The short back face of one ratchet tooth o extends from the bottom of a long front face of an adjacent ratchet tooth. The ratchet teeth inside the cap are uniformly distributed.

The short back face of each ratchet tooth has a slight slant, preferably 10 degree, off a line (a radial or diametrical line) passing through the center of the cap and the slight slant is a trailing slant.

Additionally, there are gripping means on the outside of the cap to provide a good grip for locking the cap and a bad grip for unlocking the cap. The gripping means comprise uniformly distributed ridges with a long flat side arranged almost tangentially to the circular cap and with a short steep side arranged almost radially to the circular cap on the outside of the cap.

DESCRIPTION OF THE PREFERRED EMBODIMENT(S)

Figure 1:
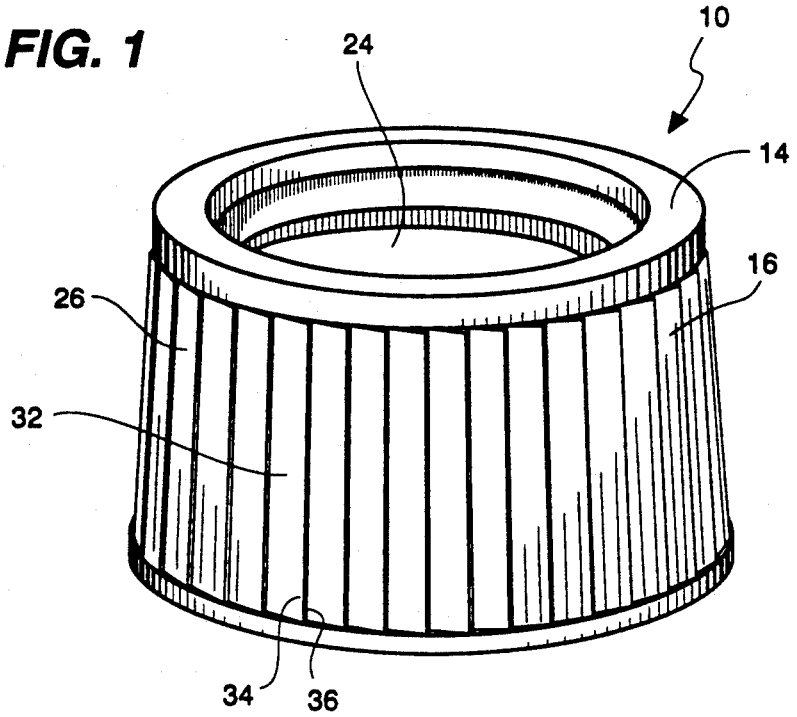
FIG. 1 is a perspective view of a ratchet cap of the connecting assembly constructed according to the teachings of the present invention.
Figure 2:
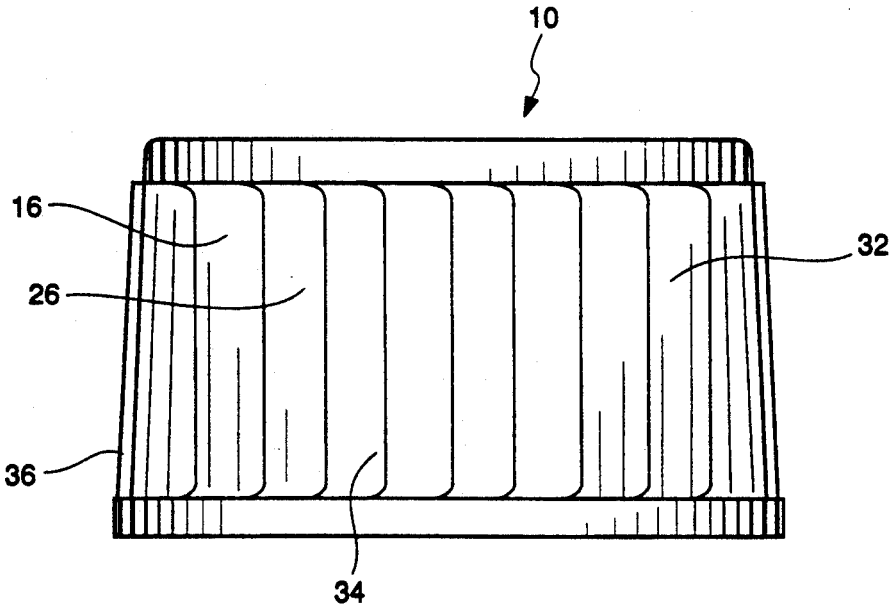
FIG. 2 is a side elevational view of the ratchet cap of the connecting assembly shown in FIG. 1.
Figure 3:
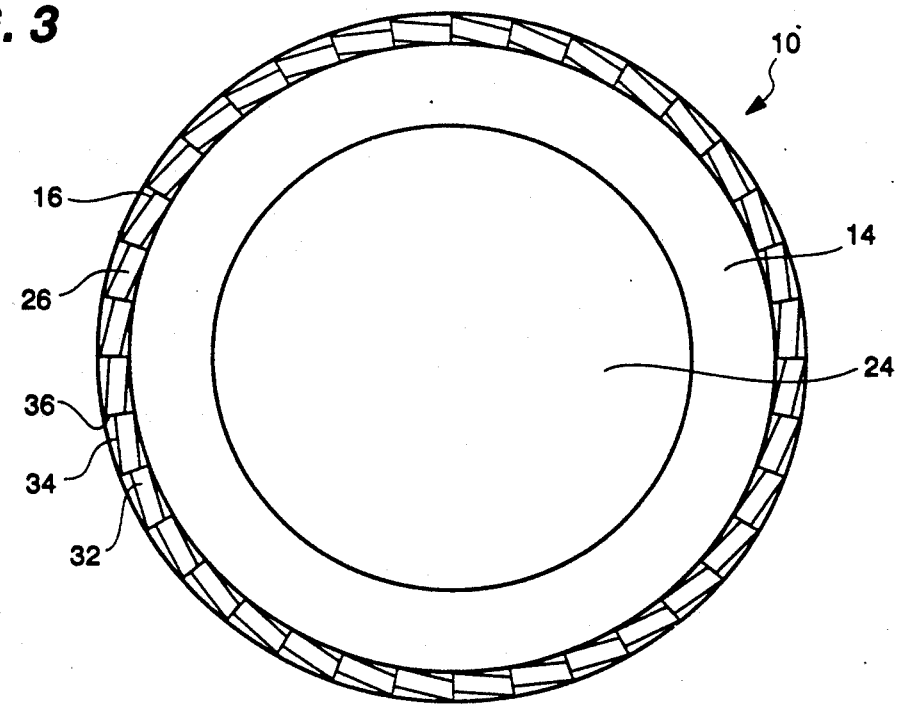
FIG. 3 is a top view of the ratchet cap of the connecting assembly shown in FIG. 1.

The connecting assembly of the present invention can be used for connecting a fluid dispensing device or a pumping mechanism, such as a trigger sprayer, to a bottle or a container carrying a desired fluid for convenient dispensing of the fluid. For mounting the dispensing device on the container, a plastic cap is used. The dispensing device is received by the cap through an orifice in its top wall, before the cap is screwed on the threaded cylindrical neck finish of the bottle or container. An air tight connection of the container and the dispensing device is provided for enabling the dispensing device or pumping mechanism to pump the desired amount of liquid out of the container.

To receive a child resistant, easy to close, hard to open and reusable trigger sprayer/bottle connection, the connecting assembly of the present invention is provided as described in more detail hereinafter.

Referring now to the drawings in greater detail, there is illustrated in FIGS. 1–5 a ratchet cap 10 of a connecting assembly for mounting a fluid dispensing device onto a container 12, constructed according to the teachings of the present invention.

The cap 10 has a cylindrical shape and comprises a top wall 14, a circular side wall 16 and a thread 18 on the inside of the circular side wall 16 for screwing the cap 10 onto a corresponding thread 20 on a cylindrical neck finish 22 of the container 12. The top wall 14 has an orifice 24 for receiving and holding a dispensing device or a pumping mechanism, respectively.

The cap 10 further comprises an arrangement of gripping ribs 26 on the outside of the circular side wall 16 of the cap 10 for providing a good grip for locking and a bad grip for unlocking of the cap 10 and an arrangement of ratchet tooth 28 on the inside of the circular side wall 16 of the ratchet cap 10 for meshing and interlocking with corresponding ratchet teeth 30 on the cylindrical neck finish 22 of the container 12.

The gripping ribs 26 are uniformly distributed around the outside of the circular side wall 16 of the cap 10 and every rib 26 is disposed adjacent a neighboring rib 26 to form a gripping ring 32. Every rib 26 has a long flat side 34 and a short steep side 36. The long flat side 34 forms a very acute angle with a tangent touching the circular side wall 16, although the long flat side 34 is almost tangential to the circular side wall 16 of the cap 10. A short steep side 36 is almost radially arranged relative to the circular side wall 16. All the gripping ribs 26 run in the same direction. This arrangement provides an easy locking and impedes unlocking of the cap 10, because the short steep side 36 of the gripping rib 26 slopes clockwise to provide a good rough grip to an operator turning the cap 10 clockwise for closing it and the long flat side 34 of the gripping tooth 26 slopes counterclockwise to provide a bad slippery grip when turning the cap 10 counterclockwise for unlocking the cap 10 and thereby impeding the unlocking of the cap 10.

The ratchet teeth 28 are uniformly distributed around the lower inside part of the circular side wall 16 of the cap 10. Every tooth 28 is disposed adjacent a neighboring tooth 28 to form a ratchet ring 38.

Each ratchet tooth 28 includes a long front face 40 and a short back face 42 whereby the long front face 40 and the short back face 42 form an acute angle, although the angle is almost rectangular.

Figure 4:
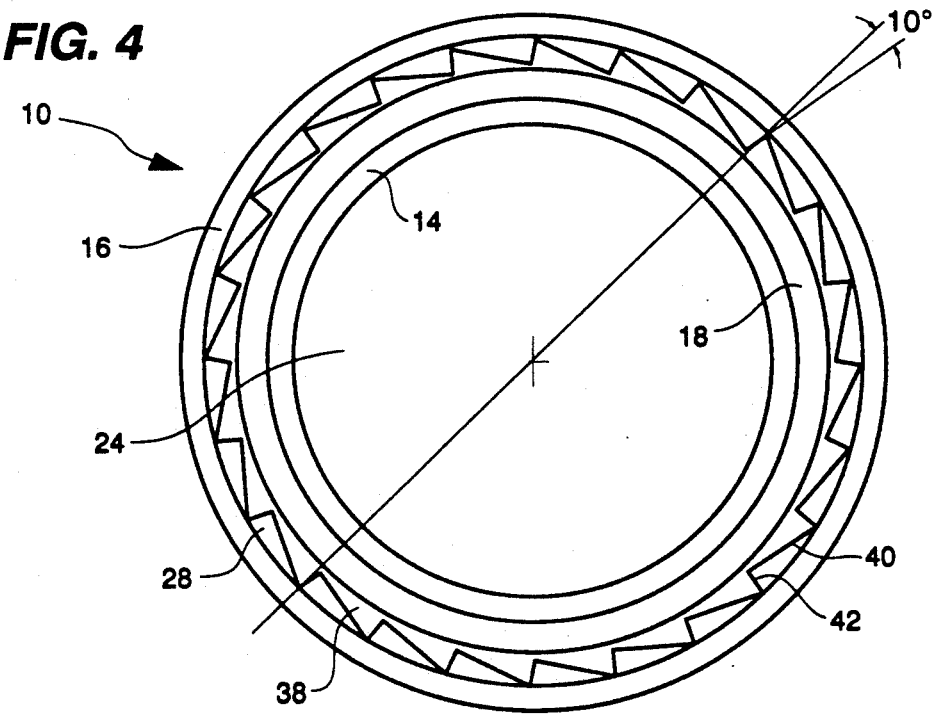
FIG. 4 is a bottom view of the ratchet cap of the connecting assembly shown in FIG. 1 and shows the trailing slant of a back face of a ratchet tooth.
Figure 5:
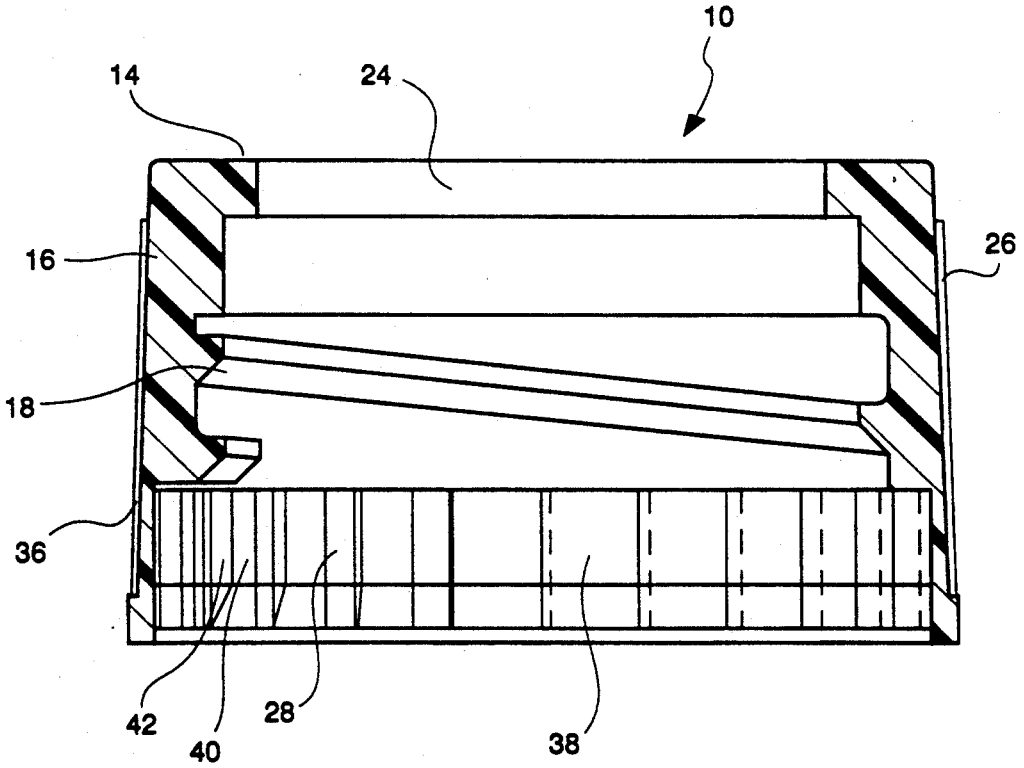
FIG. 5 is a diametrical sectional view of the ratchet cap of the connecting assembly shown in FIG. 1.

The short back face 42 is slanted relative to a radial line passing through the center of the cap 10 and forms a very acute angle of 3–30 degree, preferably 10 degree, with a radius of the cap for forming the acute, but almost rectangular angle with the long front face 40, as shown in FIG. 4.

The ratchet teeth 28 of the ratchet ring 38 are designed to mesh and interlock with corresponding ratchet teeth 30 on the cylindrical neck finish 22 of the container 12.

Figure 6:
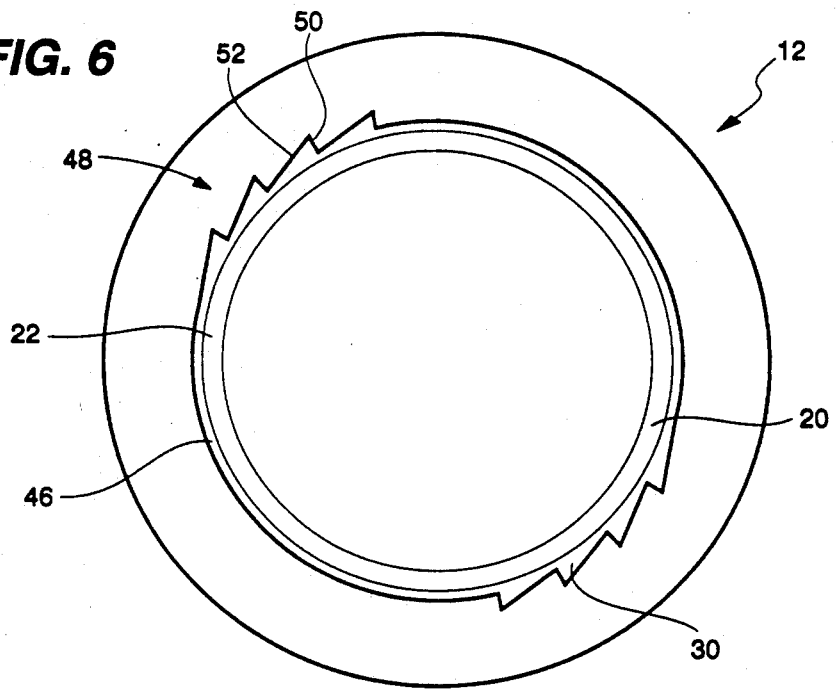
FIG. 6 is a top view of the cylindrical neck finish of the connecting assembly constructed according to the teachings of the present invention.
Figure 7:
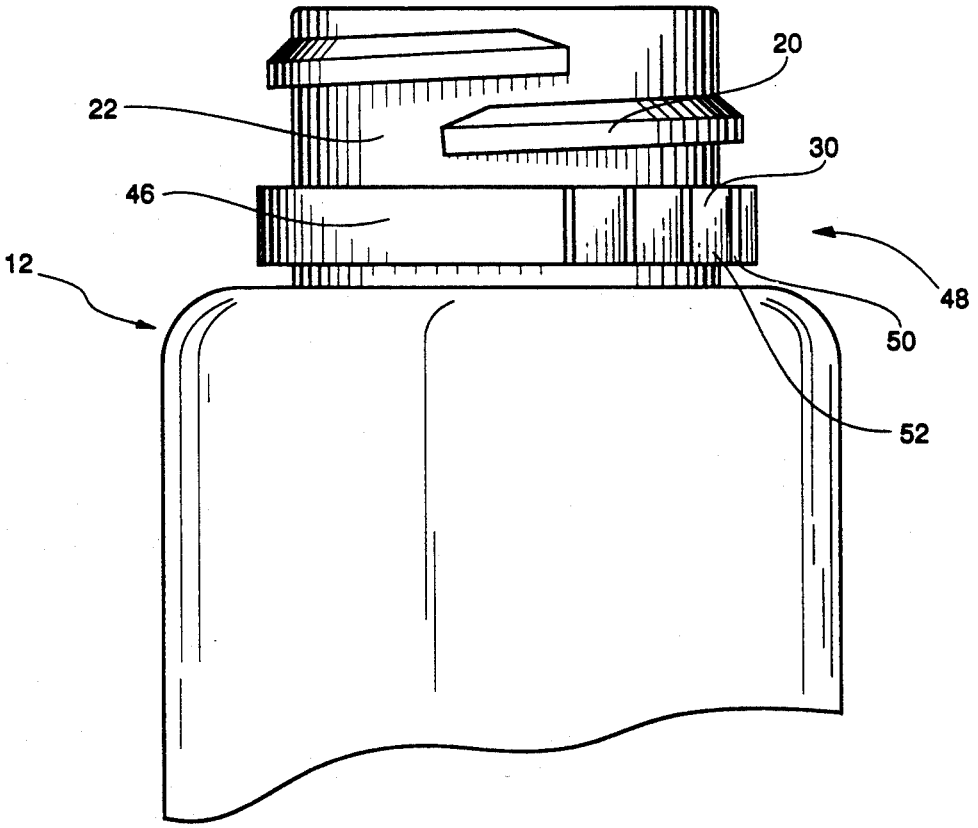
FIG. 7 is a side elevational view of the cylindrical neck finish of the connecting assembly shown in FIG. 6.

In FIGS. 6 and 7 is illustrated a cylindrical neck finish 22 of the connecting assembly constructed according to the teachings of the present invention.

The cylindrical neck finish 22 of the container 12 has a cylindrical shape and comprises a thread 20 on its upper part and a ridge 46 including two sets 48 of ratchet teeth 30 on its lower part.

Each set 48 of ratchet teeth 30 carries between one (1) and six (6), preferably four (4) ratchet teeth 30 and the two sets 48 are spaced 180 degree apart.

Each ratchet tooth 30 includes a radially arranged short back face 50 and an almost tangentially arranged long front face 52.

All the ratchet teeth 30 on the cylindrical neck finish 22 of the container 12 run in the same direction, which is opposite to the direction of the ratchet teeth 28 of the inside of the cap 10 for mutual engagement and easy locking of the cap 10.

The ratchet teeth 28 and the ratchet teeth 30 are of similar construction. In contrast to the short back face 50 of the ratchet tooth 30 on the cylindrical neck finish 22 of the container 12, the short back face 42 of the ratchet tooth 28 on the inside of the cap 10 has a slight trailing slant of 10 degrees to a radius of the cap 10, whereas the short back face 50 of the ratchet tooth 30 on the neck finish 22 is arranged radially relative to the neck finish 22. The trailing slant of the short back face 42 of the ratchet cap 10 is designed to avoid a reverse catch of the ratchet tooth 28.

By creating a trailing slant, the angle between the short back face 42 and the long front face 40 is less acute than without a trailing slant and a reverse catch of the ratchet tooth 28 is avoided. Therefore, it is much easier forcibly to remove the cap 10 from its locked position, although the gripping action locking the mutually engaged ratchet ring 38 and the sets 48 of ratchet teeth 30 is lower, it still provides a child resistant locking of the connecting assembly.

A first embodiment comprises a cylindrical neck finish 22 of the container 12 having two sets 48 of ratchet teeth 30 spaced 180 degree apart thereon, whereby each set 48 of ratchet teeth 30 includes between one and six, preferably four, ratchet teeth 30, as described above.

In this embodiment, a cap 10 constructed according to the teachings of the present invention can be removed from its locked position, because the cap 10 is made out of a form stable but flexible plastic material. By pressing on the circular side wall 16 of the cap 10 the operator can deform the cap 10 to disengage the ratchet ring 38 and the sets 48 of ratchet teeth 30 and then turn the cap 10 for unscrewing it, since the trailing slant of the short back face 42 supports the disengaging of the ratchet cap 10.

However, in a second embodiment, a cylindrical neck finish 22 of the container 12 comprises more than two sets 48 of ratchet teeth 30 uniformly distributed on the cylindrical neck finish 22, whereby each set 48 of ratchet teeth 30 includes between one and six, preferably four, ratchet teeth 30, as described above.

In this embodiment, also a cap 10 designed according to the teachings of the present invention can be used, but here a removal from a locked position is not possible, because the ratchet ring 38 and all of the sets 48 of ratchet teeth 30 can not be disengaged at the same time.

It will be apparent from the foregoing description that modifications can be made to the connecting assembly without departing from the teachings of the present invention.

Accordingly the scope of the present invention is only to be limited as necessitated by the accompanying claims.

We claim:

1. A connecting assembly for mounting a fluid dispensing device onto a container, said assembly comprising:

a cap for receiving and connecting said dispensing device onto said container;

a cylindrical neck finish on top of said container for receiving said cap;

said cap as well as said cylindrical neck finish having threads for mutual engagement;

said cap having an orifice within its top wall for receiving said fluid dispensing device;

means for locking said cap on said container for preventing said cap from being unlocked accidentally;

said means for locking including ratchet teeth inside said cap and ratchet teeth on the outside of said cylindrical neck finish arranged for mutual engagement;

said ratchet teeth inside said cap having a rearwardly extending short back face and a forwardly extending long front face whereby said short back face and said long front face form an acute but almost rectangular angle and said short back face of one ratchet tooth extends from said long front face of an adjacent ratchet tooth;

said short back faces of said ratchet teeth having a slight slant off a radial line passing through the center of said cap;

said slight slant being a trailing slant; and said ratchet teeth inside said cap being uniformly distributed whereby said light slant facilitates backing off of the rachet teeth inside the cap from the ratchet teeth on the bottle neck finish.

2. The connecting assembly of claim 1 wherein said ratchet teeth on said cylindrical neck finish are arranged in two sets of ratchet teeth located 180 degrees apart.

3. The connecting assembly of claim 2 wherein each of said sets of ratchet teeth comprises four ratchet teeth.

4. The connecting assembly of claim 2 wherein each of said sets of ratchet teeth comprises one ratchet tooth.

5. The connecting assembly of claim 2 wherein said ratchet teeth on the inside of said cap run in an opposite direction than said ratchet teeth of said cylindrical neck finish.

6. The connecting assembly of claim 1 further comprising a gripping ring on an outside of a side wall of said cap for easy locking and to impede unlocking of said connecting assembly.

7. The connecting assembly of claim 6 wherein said gripping ring comprises gripping ribs uniformly distributed on the outside of the side wall of said cap and every rib has a long flat side and a steep short side.

8. The connecting assembly of claim 7 wherein said long flat sides are almost tangentially arranged relative to the circular periphery of said cap and said short steep sides are almost radially arranged relative to a radius of said cap.

9. The connecting assembly of claim 8 wherein all said gripping ribs on the outside of said side wall are arranged in the same direction to provide a good grip for locking said cap and a bad grip for unlocking said cap.

10. The connecting assembly of claim 1 wherein said cap is made out of synthetic material.

11. The connecting assembly of claim 1 wherein said slight slant is a slant between approximately 3 and 30 degrees.

12. The connection assembly of claim 1 wherein said slight slant is approximately 10 degrees.

13. The connecting assembly of claim 1 wherein said connecting assembly is an air tight connection.

14. The connecting assembly of claim 1 wherein said ratchet teeth on said neck finish are distributed all around said neck finish.

15. A cap for mounting a fluid dispensing device onto a container;

having a cylindrical neck finish on top of the container with ratchet teeth engaging means thereon;

said cap as well having threads therein;

means for locking said cap to the container neck finish for preventing said cap from being unlocked accidentally;

said means for locking including ratchet teeth inside said cap positioned engage the ratchet teeth engaging means on the cylindrical neck finish;

said ratchet teeth inside said cap having a rearwardly extending short back face and a forwardly extending long front face whereby said short back face and said long front face form an acute but almost rectangular angle and said short back face of one ratchet tooth extends from said long front face of an adjacent ratchet tooth;

each short back face of each ratchet tooth having a slight slant off a radial line passing through the center of said cap;

said slight slant being a trailing slant; and said ratchet teeth inside said cap being uniformly distributed whereby said slight slant facilitates backing off of the ratchet teeth inside the cap from the ratchet teeth engaging means as the cylindrical neck finish.

* * * * *